US006676612B1

(12) United States Patent
Beny et al.

(10) Patent No.: US 6,676,612 B1
(45) Date of Patent: Jan. 13, 2004

(54) SPLINT FOR PASSIVE MOTION OF AN UPPER LIMB

(75) Inventors: Laurent Beny, Charroue (FR); Laurent Oster, Bogny sur Meuse (FR)

(73) Assignee: AbilityOne Corporation, Bolingbrook, IL (US)

( * ) Notice: Subject to any disclaimer, the term of this patent is extended or adjusted under 35 U.S.C. 154(b) by 0 days.

(21) Appl. No.: 09/890,962

(22) PCT Filed: Feb. 4, 2000

(86) PCT No.: PCT/FR00/00274

§ 371 (c)(1),
(2), (4) Date: Mar. 8, 2002

(87) PCT Pub. No.: WO00/47156

PCT Pub. Date: Aug. 17, 2000

(30) Foreign Application Priority Data

Feb. 8, 1999 (FR) ..... 99/01579

(51) Int. Cl.[7] ..... A61H 1/02
(52) U.S. Cl. ..... 601/5; 601/26; 601/33
(58) Field of Search ..... 601/5, 23, 24, 601/26, 33, 90, 93, 91; 482/100

(56) References Cited

U.S. PATENT DOCUMENTS 4,669,451 A * 6/1987 Blauth et al. ..... 601/33
5,158,074 A * 10/1992 Grellas ..... 601/24
5,163,451 A * 11/1992 Grellas ..... 601/33
5,179,939 A * 1/1993 Donovan et al. ..... 601/33
5,417,643 A * 5/1995 Taylor ..... 601/33
6,007,500 A * 12/1999 Quintinskie, Jr. ..... 601/5

OTHER PUBLICATIONS

Blauth, "Exercising devices for CPM treatment. Fundamentals, Characteristics, Experiences," *Med. Orth. Tech.*, pp. 178–186 (04/91).

* cited by examiner

*Primary Examiner*—Danton DeMille
(74) *Attorney, Agent, or Firm*—McDonnell Boehnen Hulbert & Berghoff

(57) ABSTRACT

Rehabilitation of an upper limb. The splint comprises: an arm (8) that is supported by a frame (10) consisting of at least one upper extension (20) that is provided at the end of a pivot (21) of a substantially vertical axis, an arch that is mounted on the pivot by means of a flexion-extensional drive motor (26) for the upper member, and an upper structure (31) that supports the anti-brachial and brachial segments and is comprised of a housing (34) that is adapted onto said arch, an abduction-adduction drive motor for the upper arm and an arm (40) that links said motor to the brachial segment. The invention can be used for passive motion splints.

14 Claims, 7 Drawing Sheets

SPLINT FOR PASSIVE MOTION OF AN UPPER LIMB

BACKGROUND OF THE INVENTION

This application claims priority to French Application No. 99/01579 filed on Feb. 8, 1999, by the same inventors and having the same title as above, the entire contents of which is hereby incorporated by reference.

1. Field of the Invention

The present invention concerns articular and ligament rehabilitation of the upper limbs, and more particularly, the rehabilitation of such limbs by the passive motion method.

Such method consists of placing the upper limb in a splint that is comprised of articulated segments reproducing and giving effect to complex scapular-humeral articulation, as well as to the equally complex ulnar articulation. The design of these articulated segments is such as to allow the arm and forearm of the upper limb to be moved by means of variable speed motorized devices in specific angular ranges in the principal movements considered, effected independently or concomitantly, which movements are abduction-adduction, horizontal flexion-extension, internal-external rotation of the forearm, and even the pronation-supination of said forearm.

2. Description of the Related Art

Splints able to meet these requirements, taking into account the anatomical characteristics of the articulations of the upper limb, are well known and can be considered to meet the objectives.

In general, due to their functionality such splints are heavy, relatively bulky, and for some, can only be used with a right or left upper limb.

In practice up until the present, the implementation of such passive motion splints was generally done within a medical or paramedical environment, in specialized structures and by personnel specifically trained in that regard.

Advances made in servo technology, motorization control and adjustment devices adapted to said splints have opened a door to a different practice consisting of providing a patient with a passive motion rehabilitation splint along with an implementation protocol that the patient himself can adapt to.

Given the formulation of such a proposal, the question arises of making such a splint personally available to a patient, it being understood that, in any event, the use of such a splint is temporary.

This is the reason there has been a trend toward offering upper limb motion splints for rent, so that each patient concerned can have temporary access to the equipment he needs to follow the rehabilitation protocol appropriate to him.

Although such practice of making available a passive motion splint would seem to be satisfactory, in practice, it has two principal difficulties.

The first concerns the bulkiness and weight represented by such passive motion splints for an upper limb, a bulkiness and weight that generally hamper a flexible, fast and effective rental service that only requires a simple means of transport for the patient.

The second is that of having equipment that can meet rental needs that are difficult to foresee, for rehabilitation of either the right or left upper limb.

These two obstacles appear to be a serious hindrance to the development of the rental practice.

The object of the invention is precisely to overcome the problems posed by current passive rehabilitation equipment, by proposing a new upper limb rehabilitation splint that has relatively small overall dimensions, can be installed and used practically and quickly, and can be used in the rehabilitation of either a right or left arm, subject to adaptation adjustment. Such adaptation adjustment is most often left to personnel responsible for the first installation who can, from a single set of identical machines, meet all rental demands that could arise completely randomly.

SUMMARY OF THE INVENTION

In order to achieve the foregoing objectives, the splint for passive motion of an upper arm, of the type having an ante-brachial segment and a brachial segment that are relatively adjustable for flexion-extension and are adapted to a frame for support and motion in (independent and/or simultaneous) movements of horizontal flexion-extension of the upper limb, abduction-adduction of said limb, internal-external rotation of the forearm, and even pronation-supination, is characterized in that said frame comprises:

- a substantially vertical arm held by a frame which is intended to be placed in relation to the back of an associated chair and which has at least one upper extension, provided at the end with a pivot that has a substantially vertical axis, known as horizontal flexion-extension of the upper limb and oriented toward the front of said seat,
- an arch that is mounted on the pivot by means of a drive motor for the horizontal flexion-extension of the upper limb,
- and an upper structure supporting the ante-brachial and brachial segments and having a housing adapted to the arch, a drive motor for abduction-adduction of the upper limb, mounted in the housing and an arm linking said motor to the brachial segment.

Various other characteristics will be seen from the description provided below, with reference to the attached drawings which show, by way of non-limiting examples, embodiments of the object of the invention.

DETAILED DESCRIPTION OF THE INVENTION

Figure 2:
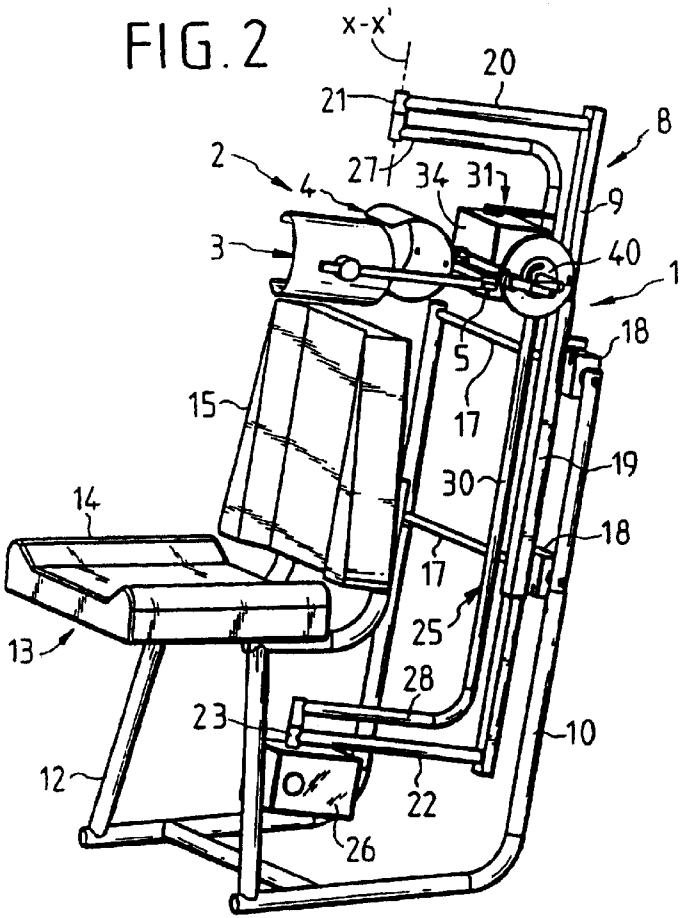
FIGS. 2, 3 and 4 are perspectives, corresponding to FIG. 1 and showing construction details in different scales.
Figure 1:
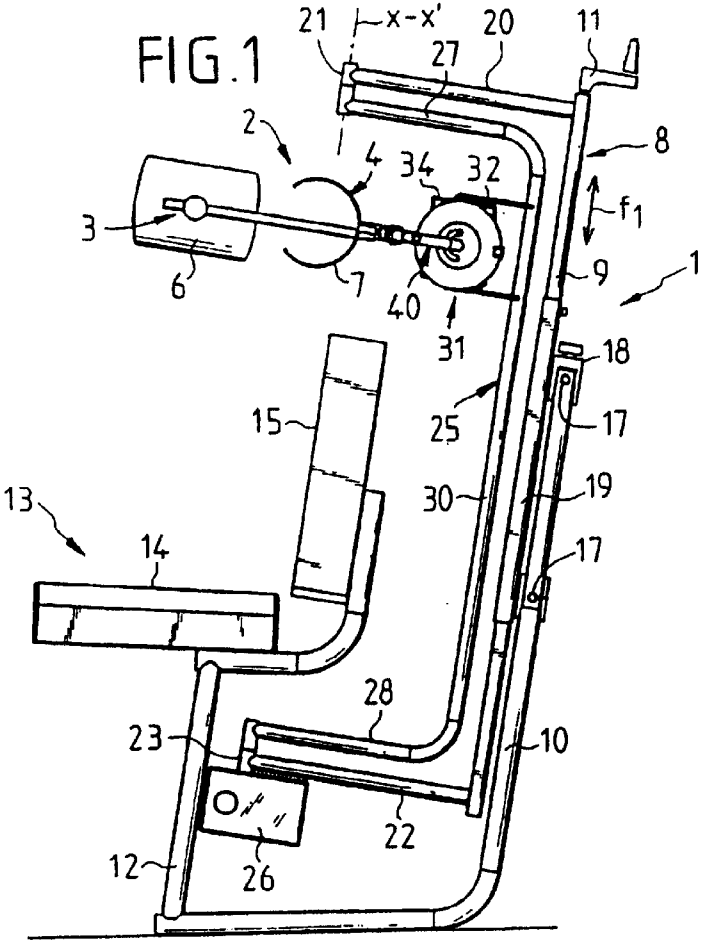
FIG. 1 is an elevation of the splint according to the invention, in a first embodiment.
Figure 4:
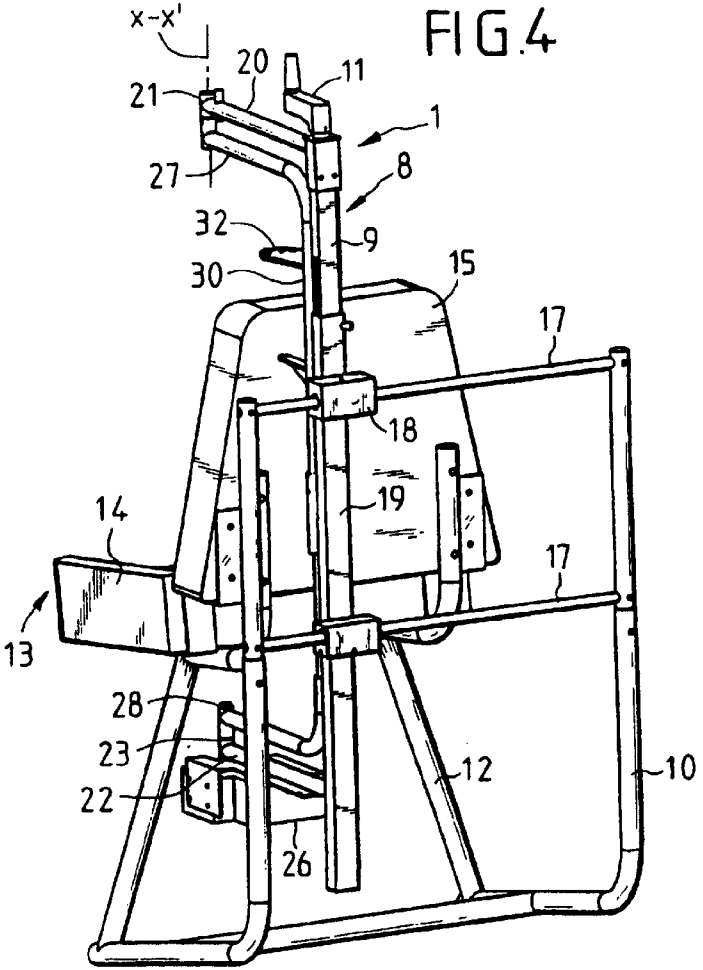

Based on the example of embodiment illustrated in FIGS. 1 to 4, the passive motion splint, according to the invention, has a frame 1 for support and motion, in independent and/or simultaneous movements, of an assembly 2 composed of an ante-brachial segment 3 and by a brachial segment 4 which are linked by an ulnar articulation 5 that can be immobilized in an adjustable angular position. In the illustrated example, segments 3 and 4 are immobilized in an orthogonal orientation in correspondence with the support of an upper left limb, by means of a trough 6 to hold the forearm and a trough 7 to hold the arm.

The frame 1 is composed of an arm 8 which has a column 9 held by a frame 10, with which such column can be adjusted in either direction along the arrow $f_1$, for example by a screw system 11.

In the illustrated example, the frame 10 is an integral part of the base 12 of a chair 13 having a seat 14 and a back 15 intended to be occupied by a seated patient, whose upper left limb, in this instance, is to be given rehabilitation.

Figure 5:
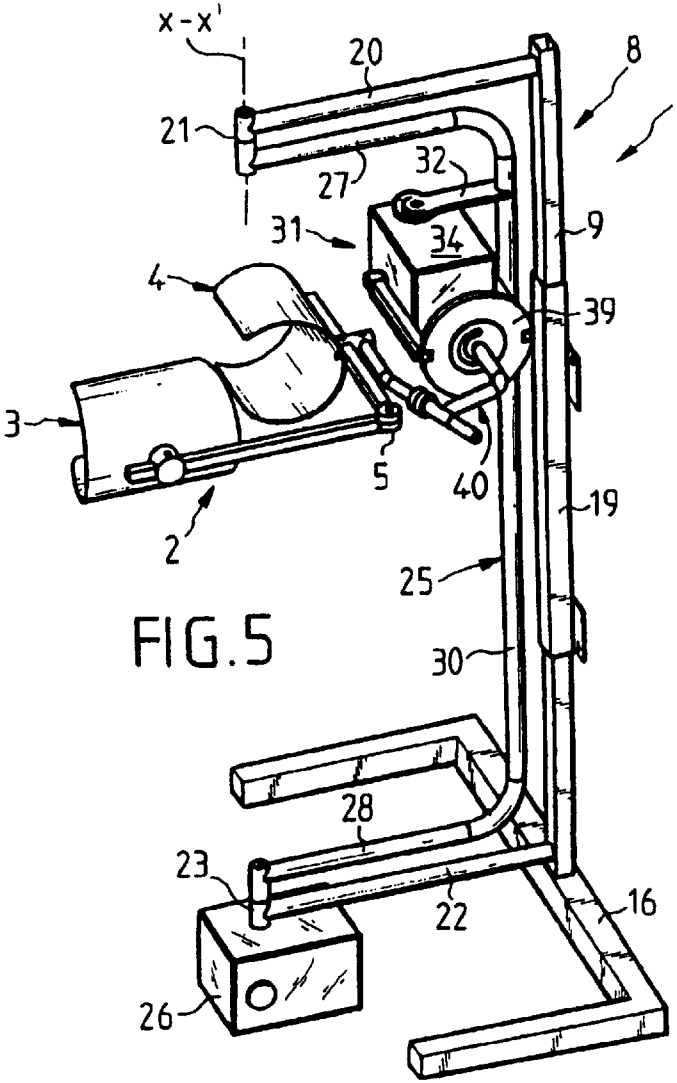
FIG. 5 is a perspective, substantially similar to FIG. 2, but illustrating a variation of embodiment.

It should be considered, within the meaning of the invention, that the frame 10 could be raised from a base 16, like the one illustrated in FIG. 5, such base being then independent of the seat 13.

Within the principal objective of the invention is that of implementing means so that the frame 1 can be placed equally well in relation with the left side of the chair 13, as illustrated in the drawings, or in relation with the right side, in such a way that, by the means subsequently described in relation to the purpose of the invention, the motion splint can perform its rehabilitation function equally well for the patient's right or left arm.

Within the scope of the variation according to FIG. 5, such means involve the design of the independent nature of the base 16, which makes it possible to place the column 9 of the arm 8 to the left or right of the chair 13.

In the embodiment in which the frame 10 is an integral part of the base 12, one or more horizontal slide rails 17 are provided (as is diagrammed in FIGS. 1 to 4), on which a holder 18 that provides support for the column 9 by means of a shaft 19, is mounted.

Figure 3:
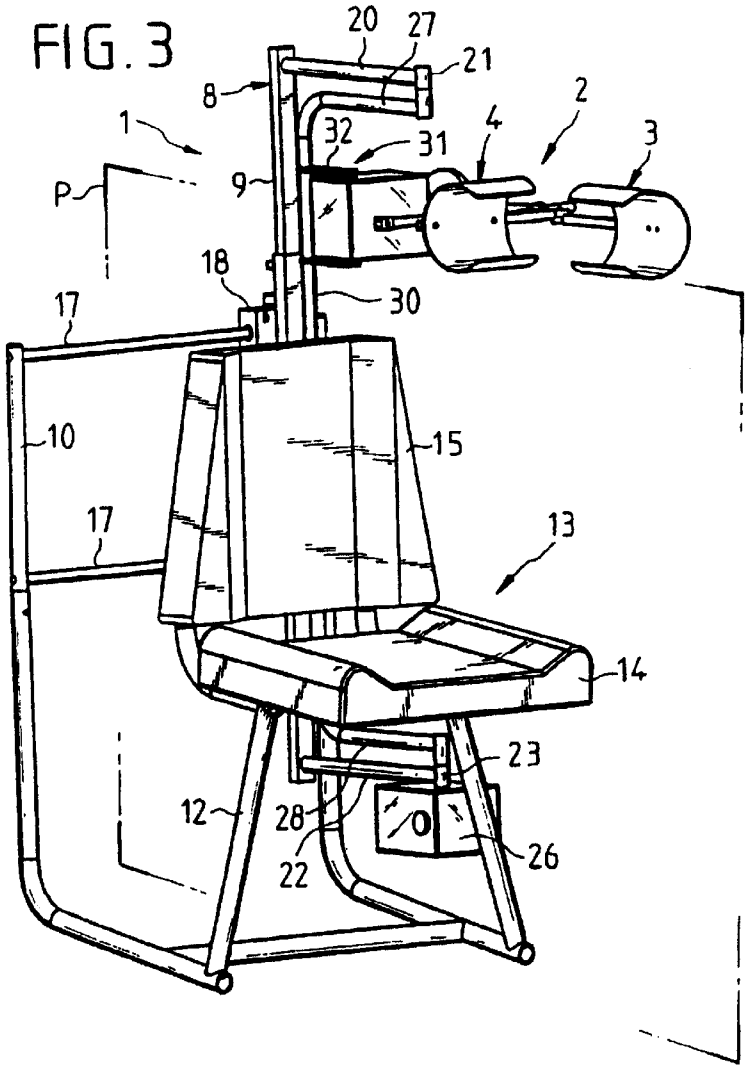

By the means described above, the arm 8 can be placed to the right or left, with respect to an anterior-posterior mean plane P of the chair 13 (FIG. 3).

The arm 8 has at least one upper extension 20 which, with respect to the frame 10, is oriented toward the front of the associated chair 13. The extension 20 defines, at the end, a pivot 21 that has an axis x–x' that is substantially vertical and which can be placed in line with the right or left scapular-humeral articulation head for a patient occupying the chair 13.

The arm 8 is preferably also provided with a lower extension 22, which has the same characteristics as the extension 20, so as to have a pivot 23 that is coaxial with the pivot 21 in order to ensure a single axis x–x'.

If applicable, the pivot 21 and the pivot 23 are reserved for mounting a substantially U-shaped arch 25, which can be immobilized or driven in rotation by a horizontal flexion-extension motor 26 for the upper limb.

Figure 6:
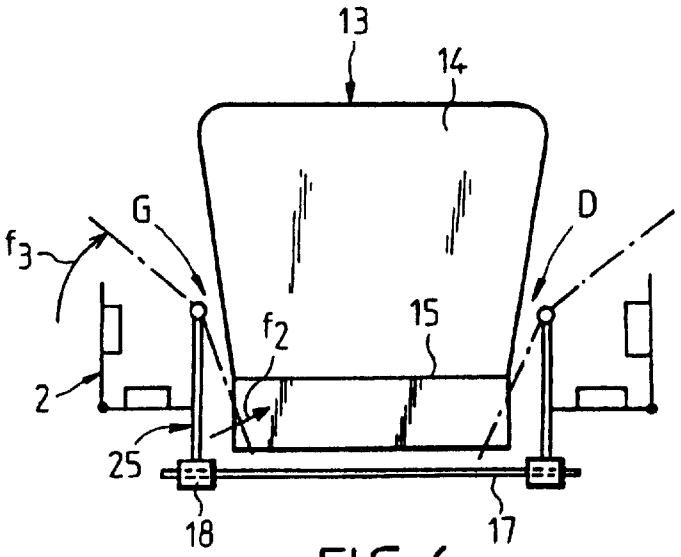
FIG. 6 is a top view diagram showing certain structural characteristics of the splint.

The motor 26 is designed, as is diagrammed in FIG. 6, in such a way as to be able to drive the angular motion of the arch 25, whether the arm 8 is arranged in left or right lateral placement, or in the direction of the arrow $f_2$ within an angular range of 30°, or in the direction of $f_3$ within an angular range of 130°.

The arch 25 is composed of two arms 27 and 28 which, in a neutral position, extend parallel to the extensions 20 and 22 starting from the pivots 21 and 23, and of a web 30 connecting said arms, which web is placed, in the same position of reference, substantially parallel to the column 9.

The arch 25 carries the assembly 2 by means of a structure 31 occupying a position that is substantially higher on the web 30 below the arm 27, so as to be able to be situated substantially in line with the right or left shoulder of a patient occupying the chair 13. Such a vertical adjustment of the shoulder can be made by the means 11, offering the possibility, as mentioned above, of moving the column 9 with respect to the frame 10, according to the arrow $f_1$.

Figure 7:
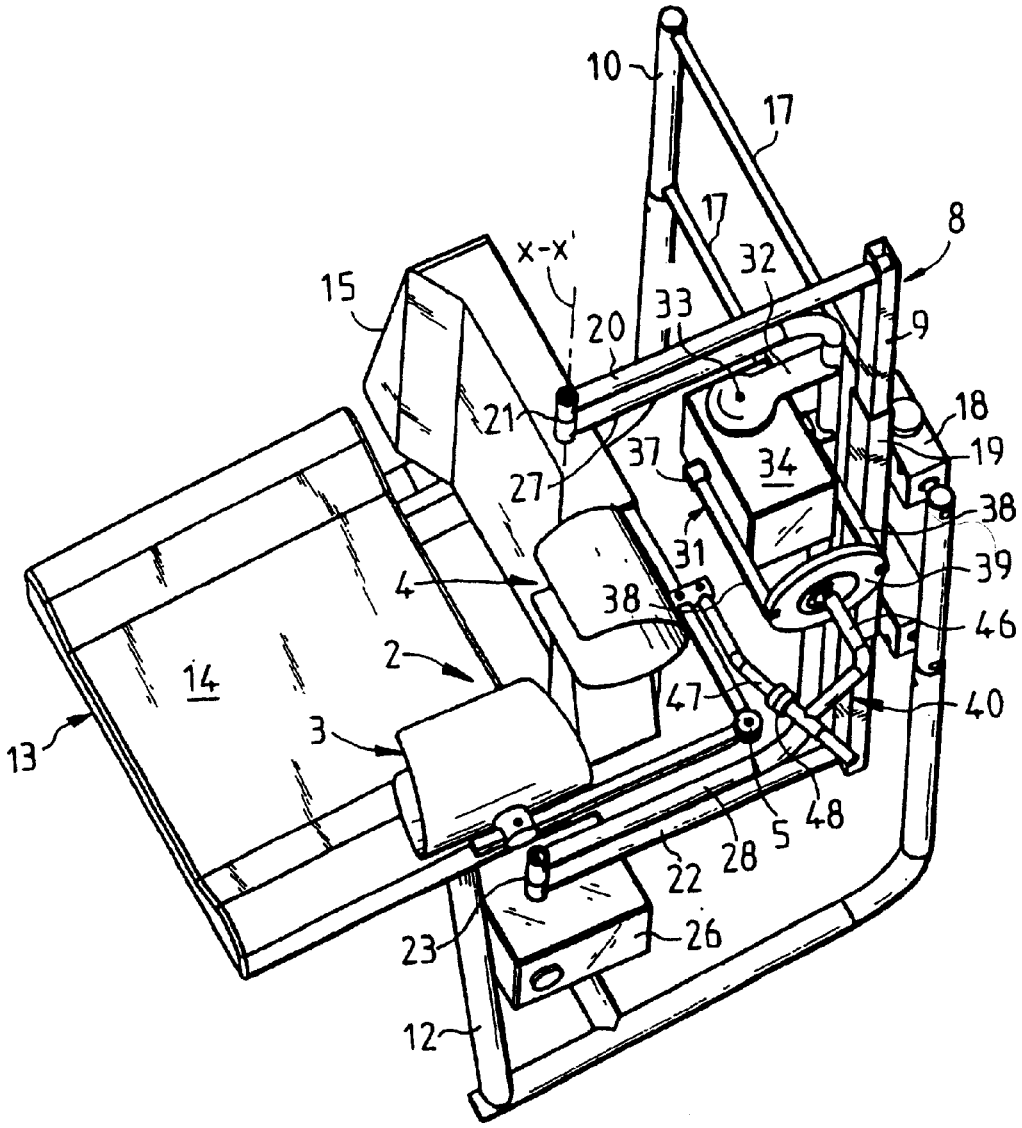
FIG. 7 is a perspective showing more precisely the structure of the splint.
Figure 8:
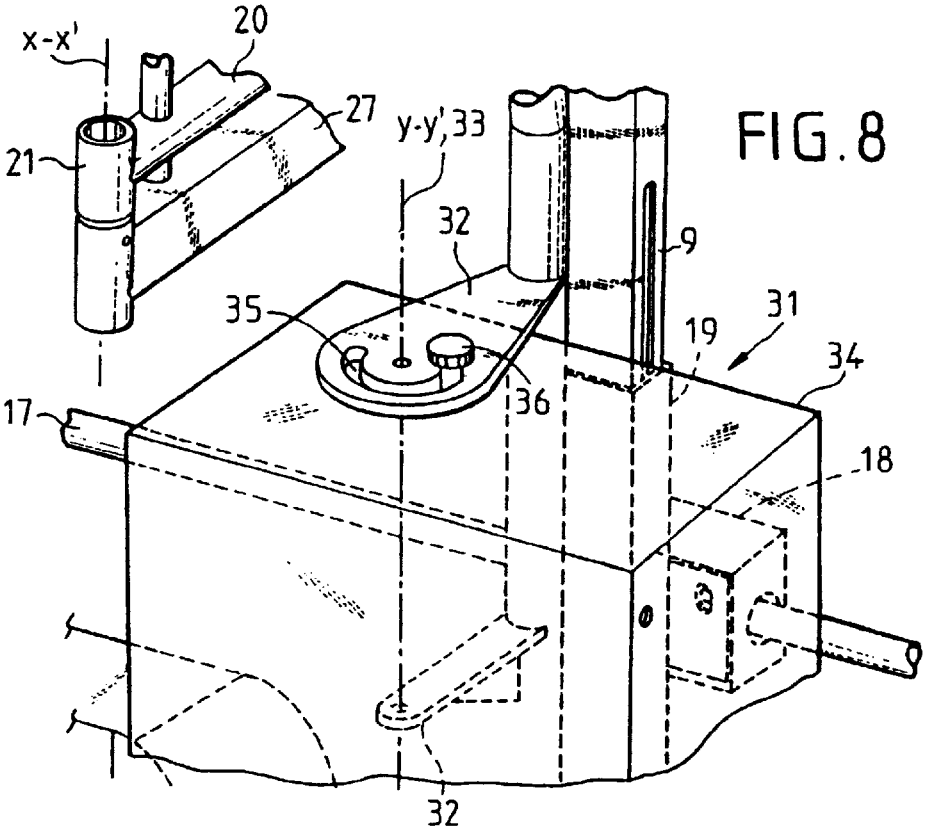
FIGS. 8 and 9 are partial perspectives, in a larger scale, showing details of the construction.

The structure 31, shown more clearly in FIGS. 5 and 7, comprises a support 32, which is preferably made in the form of a bracket or a clevis oriented parallel to the arms 27 and 28. The support 32 defines a substantially vertical pivoting axis y–y' for a housing 34, mounted on the support 32 by a pivot 33 and by an orientation means 35, which is more clearly illustrated in FIG. 8. Such means 35 have, for example, in the upper arm of the clevis or support 32, a semicircular opening 35 centered on the pivoting axis y–y', which receives and guides a locking button 36 carried by the housing 34. The opening 35 covers an angular range on the order of 180°, so that it is possible, by moving the locking device 36, to orient the housing 34 in one or the other of two stable positions, 180° from each other.

Figure 9:
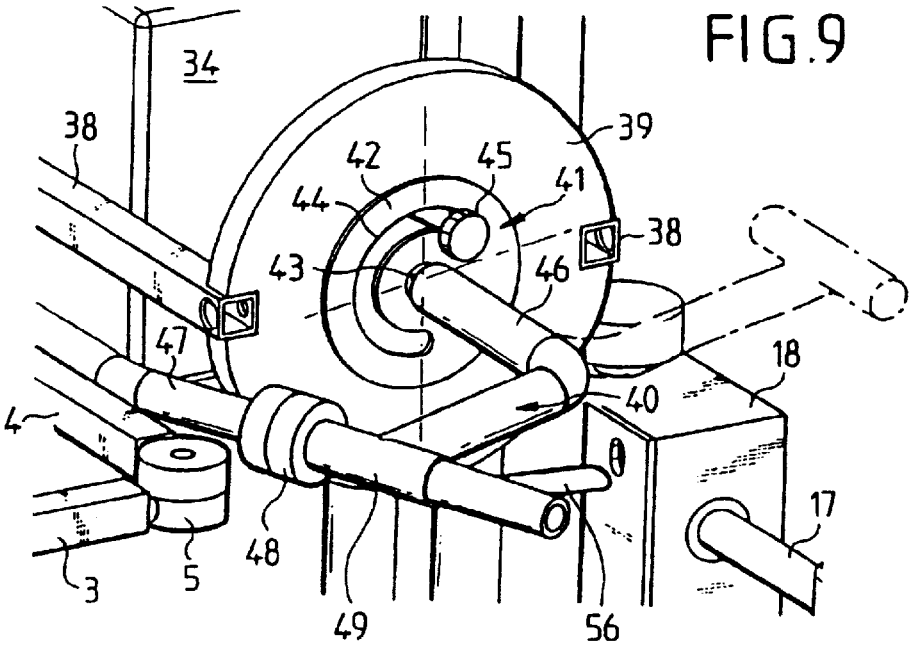

The housing 34 encloses a motor having an output shaft 37, the axis of which is orthogonal to the axis y–y' and which extends, in one or the other of the orientation positions of the housing 34, always parallel to the arms 27 and 28 of the arch 25. The output shaft 37 drives one, or preferably two, members 38 extending transversally to the plane of the arch and carrying a turn plate 39, which provides the support for the assembly 2 by means of an arm 40. The plate 39 is associated with turn adjustment means 41 for the arm 40. These means 41, as illustrated in FIG. 9, have a mechanism plate 42 mounted on an axis of rotation 43 presented by the plate 39 and having a semicircular opening 44 to accept an attachment and adjustment device 45, for example carried by the plate 39. The opening 44 covers an angular range of 180°, in such a way that it becomes possible to adjust the orientation of the arm 40 by turning it in one or the other of two positions, for example the first being the position illustrated in FIG. 9, and the second illustrated in the same figure by the broken line, the necessity for these two positions being explained as follows.

The arm 40 is comprised of a semi-arm 46, called posterior, forming one piece with the mechanism plate 42, and a semi-arm 47, called anterior, which carries the brachial segment 4 of the assembly 2. The semi-arms 46 and 47 are associated by a coupling 48, which is combined with a bearing 49 for the free rotation of the semi-arm 47 in the event of release of the coupling 48.

The motor in the housing 34 is designed to be able to operate in reversible rotation, at variable speed, in an angular range capable of causing an adduction movement within a range of 20° and an abduction movement within a range of close to 150°.

The implementation of the motion splint described above is done as follows.

For example, when the passive motion of a left upper limb is concerned, the arm 8 is laced to the left of the chair 13, as diagrammed in letter G of FIG. 6, by means of the frame 10, behind the back 15 of the chair 13 and laterally thereto, so that the axis x–x' corresponds substantially to the scapular-humeral articulation head of the upper left arm.

Next, the housing 34 is adjusted by the means 35 and 36, so as to immobilize this housing in an orientation such that the members 38 are oriented and directed toward the left, as illustrated in FIGS. 1 to 5 and 7.

The means 44 and 45 of the return plate 30 are used to orient the arm 40 in the opposite direction of that of the frame 10, that is, toward the front of the chair 13, so as to place the assembly 2 in a situation favorable to receiving and holding the forearm and the arm of the upper limb in the troughs 6 and 7.

In such a position, it is possible to control a horizontal flexion-extension passive motion rehabilitation of the left upper arm by controlling the power to the motor 26 which moves the arch 25 in an angular range of 30° in the direction of the arrow $f_2$ and in a range of 130° in the direction of the arrow $f_3$.

It is also possible to control a rehabilitational passive motion of the upper arm by adduction and abduction movements by controlling the proper and suitable sequential power supply to the abduction-adduction drive motor enclosed in the housing 34.

It is obviously quite possible to provide the concomitant control of both movements by adopting speeds and amplitudes that are predetermined and programmable each time.

The examples of rehabilitation movements that have just been discussed take into account a position of the upper arm which is held and immobilized by the segments 3 and 4 that have, as a function of the ulnar articulation adjustment 5, a relational position of substantially 90° flexion.

It is obvious that the movements above can be programmed, maintaining the upper limb in full extension, by first adjusting the ulnar articulation 5.

Assuming that the motion splint is to be used for the rehabilitation of a right arm, it is sufficient to place the arm 8 in relation to the right position, as shown by letter D in FIG. 6. This is done either directly by means of the base 16, or by adjusting the holder 18 on the slide rail(s) 17.

Figure 10:
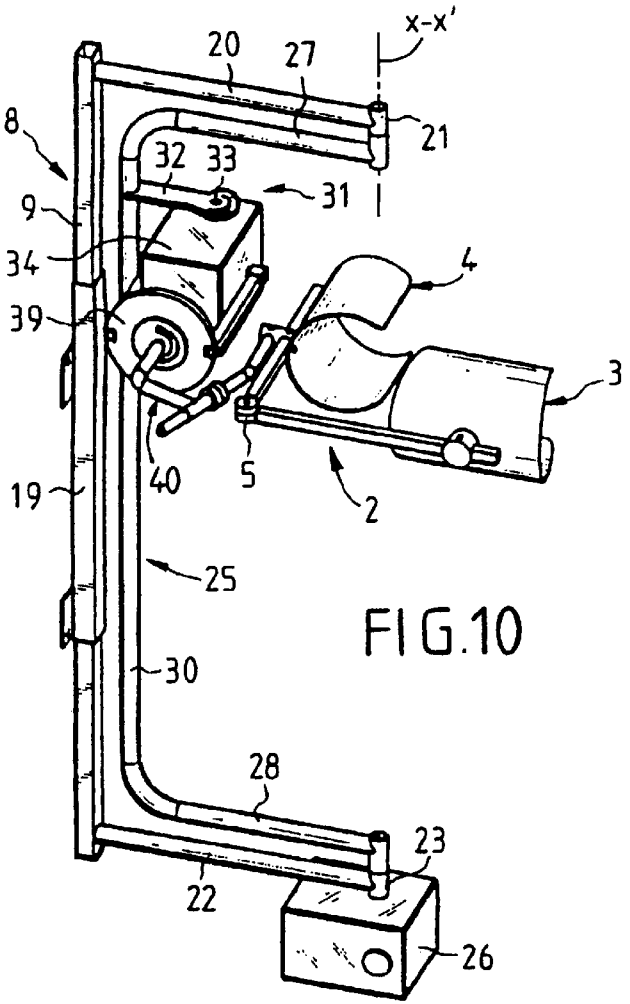
FIG. 10 is a partial perspective, similar to FIG. 5, but illustrating a functional characteristic.

Next, the means 35 and 36 are implemented to control the change of orientation of the housing 34 on the axis y–y', so as to orient the arm 40 toward the exterior of the right side of the chair 13. Finally, the means 44 and 45 are controlled to cause the turning of the assembly 2 and to bring it back in the direction of the front of the chair 13, in such a way that the splint then occupies the position, as illustrated in FIG. 10, in which the same movements as those described before can be individually or concomitantly controlled.

The object of the invention also includes means designated in the aggregate by the reference 50 and suitable for maintaining an internal-external rotational movement of the forearm or the upper limb, such rotational movement occurring concomitantly with the abduction-adduction movement maintained by the motor in the housing 34.

Figure 11:
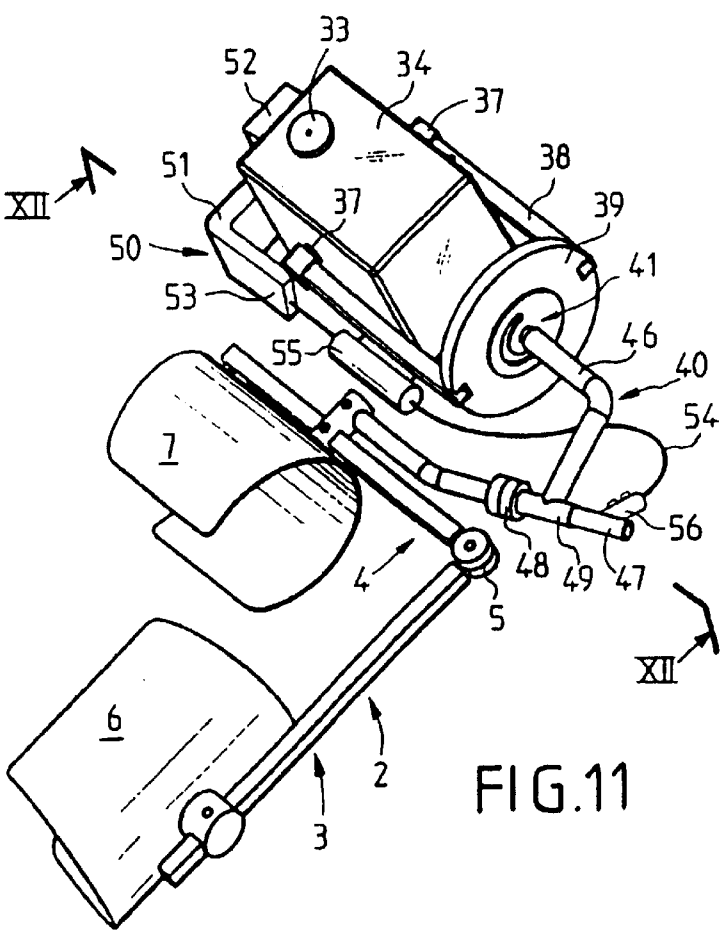
FIG. 11 is a partial perspective showing one variation of embodiment.
Figure 12:
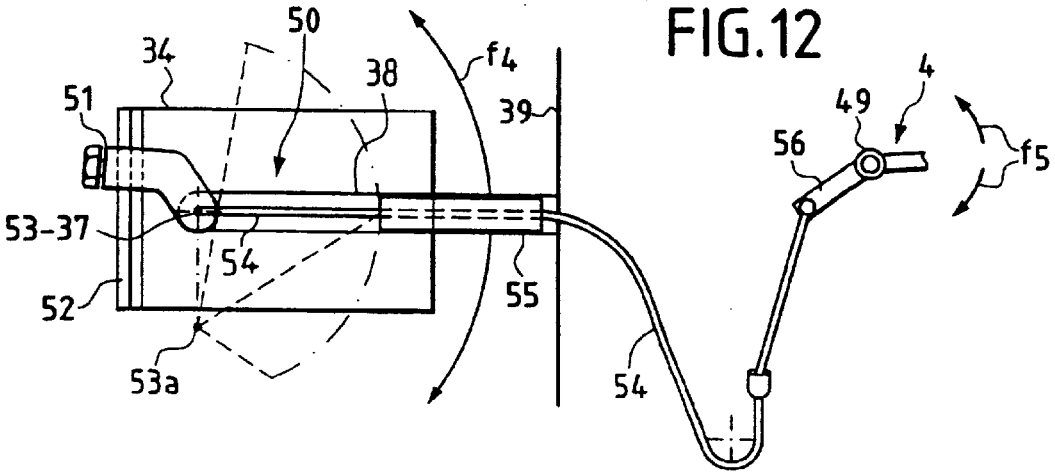
FIG. 12 is a side elevation, in larger scale, shown diagrammatically, substantially along plane XII—XII of FIG. 11.
Figure 13:
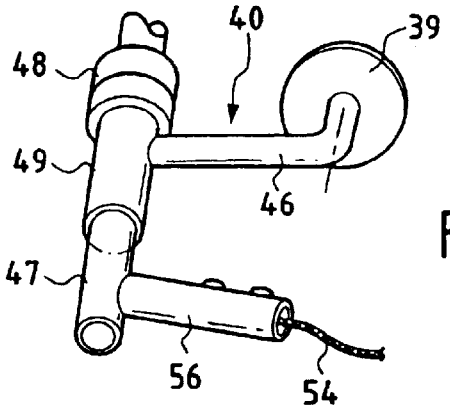
FIG. 13 is a partial perspective showing more clearly the construction according to FIG. 12.

FIGS. 11 and 12 show that the means 50 include a fork 51, the position of which can be adjusted on a slide 52, provided by the housing 34. The fork 51 provides a point of attachment 53 which can be placed, depending on the adjustment of the slide 52, either to coincide with the axis of the output shaft 37, or vertically offset with respect to said output shaft, and more particularly, in descending vertical movement. The point of attachment 53 is intended for the attachment of the end of a cable 54 held by a guide sleeve 55, in such a way that its opposite end can be adjustably attached to an arm 56 that forms one piece with the semi-arm 47.

By providing for the release of the coupling 48, the means 50, as described above, make it possible to achieve the following results.

When the fork 51 is adjusted so that the point of attachment 53 coincides with the axis 37, the angular movement of the members 35 has no effect on the useful length of the cable 54.

Figure 14:
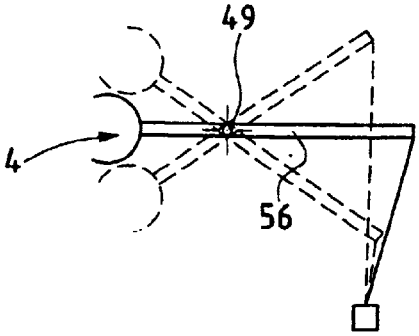
FIG. 14 is a partial diagram illustrating a functional characteristic of the means according to FIGS. 11 and 12.

However, if the adjustment of the fork 51 brings the point of attachment 53 to a position such as 53*a*, illustrated in FIG. 12, then the angular displacement in either direction of the arrow $f_1$ of the members 35 results in a corresponding variation in the useful length of said cable, between the point of attachment and where it enters the cable guide sleeve 55, so that this cable controls, by means of the arm 56, the rotation in either of the directions of the arrow $f_3$ of the semi-arm 47, as illustrated in FIGS. 12 and 14. Consequently, concomitant with the abduction-adduction movement, there is an external-internal rotational movement applied to the forearm of the upper limb when said limb is placed in a semi-flexed state.

When the prior adjustment of the assembly 2 places the segments 3 and 4 in alignment for an extension of the upper limb, then the adjustment, as considered in the foregoing, results in the creation of, simultaneous with the abduction-adduction movement, a supination-pronation movement that makes it possible to offer the additional possibility of passive motion that can be combined with a horizontal flexion-extension.

The invention has a valuable application in the area of passive motion splints that are reserved for rental services.

What is claimed is:

1. A splint for passive motion of an upper arm—of the type having a ante-brachial segment and a brachial segment that are relatively adjustable for flexion-extension and are adapted to a frame for support and motion in (independent and/or simultaneous) movements of horizontal flexion-extension of the upper limb, abduction-adduction of said limb, internal-external rotation of the forearm, and pronation-supination, wherein the frame comprises:

a substantially vertical arm held by a frame, which has at least one upper extension provided at the end with a pivot that has substantially vertical axis, known as horizontal flexion-extension axis of the upper limb, an arch that is mounted on the pivot and is connected to a drive motor for horizontal flexion-extension of the upper limb, and an upper structure supporting the ante-brachial and brachial segments and having a housing connected to the arch, a drive motor for abduction-adduction of the upper limb, mounted in the housing and an arm linking said motor to the brachial segment.

2. The splint according to claim 1, wherein the frame is connected to and rises vertically from a base.

3. The splint according to claim 1, wherein the frame is connected to a chair.

4. The splint according to claim 1, wherein the arm is mounted vertically adjustable with respect to the frame.

5. The splint according to claim 1, wherein the arm has a lower extension and the upper extension and lower extension have coaxial pivots with axis (x–x'), on which pivots the arch is mounted.

6. The splint according to claim 1, wherein the arm is mounted on the frame by a shaft linked to a holder adjustably fitted to at least one horizontal slide rail comprising part of the frame and extending along a length, such that the axis (x–x') of the pivot of the arm can be placed reversibly in line with the right or left scapular-humeral articulation head of a person occupying the associated chair.

7. The splint according to claim 1, wherein the arm carries the arch, the arch being furnished with an upper support, provided, for the mounting of the housing, with an orientation pivot, the axis of which is parallel to the horizontal flexion-extension axis of the upper limb and in which a linking arm, between the abduction-adduction motor and the brachial segment, has a turn plate, the axis of which is orthogonal to that of the orientation pivot.

8. The splint according to claim 7, wherein the orientation pivot has a first immobilization member adapted to immobilize the housing in either of two positions'situated at 180° from each other and in each of which positions the turn plate is oriented respectively to the left and to the right, relative to the associated chair and in which said plate is provided with a second immobilization member adapted for immobilizing both the ante-brachial and brachial segments in one or the other of the two positions established in correspondence with the two positions of orientation of the housing, and in each of which positions the brachial segment is oriented toward the front of the associated chair.

9. The splint according to claim 8, wherein the motor for abduction-adduction of the upper limb has an output shaft oriented according to an anterior-posterior direction with respect to the associated chair, in either of the positions that said housing can adopt, such shaft driving at least one member linked to a turn plate, on which the arm is mounted on an angularly adjustable mechanism plate.

10. The splint according to claim 1, wherein the abduction-adduction drive motor can be actuated with a variable speed reversible rotation in an adjustable angular range.

11. The splint according to claim 1, wherein the drive motor for the horizontal flexion-extension of the upper limb can be actuated with a variable speed reversible rotation in an angular range, such that the arch can be moved from a neutral position of alignment parallel to the anterior-posterior plane (P) of the associated chair, in external rotation in a range of 30° and in internal rotation in a range of 130°.

12. The splint according to claim 1, wherein the arm is composed of a semi-arm, called posterior, linked to a mechanism plate of a turn plate and of a semi-arm, called anterior, carrying the brachial segment, these semi-arms being joined by a coupling.

13. The splint according to claim 12, wherein the coupling is associated with a bearing of free rotation of the anterior semi-arm, which is provided with an arm that can be operated by an adjustable device to move the anterior semi-arm in internal-external rotation of the forearm of the upper limb, concomitantly with at least the abduction-adduction movement of said upper limb.

14. The splint according to claim 13, wherein the internal-external rotation adjustable device of the forearm of the upper limb comprises:

a fork adjustably mounted in position on a slide, provided by the housing and providing a point of attachment, which can be placed either to coincide with the axis of the output shaft of the abduction-adduction drive motor, or vertically offset with respect to said axis, a guided cable, which is linked to the point of attachment and adjustably mounted by length on the arm of the anterior semi-arm.

* * * * *